US007257862B2

(12) United States Patent
Bassi

(10) Patent No.: US 7,257,862 B2
(45) Date of Patent: Aug. 21, 2007

(54) DECELERATING DEVICE FOR INSERTION BETWEEN TWO RELATIVELY ROTATING MEMBERS, IN PARTICULAR A DRUM AND AN OSCILLATING DOOR FOR LOADING THE DRUM IN A TOP-LOADED WASHING MACHINE

(75) Inventor: Alberto Bassi, Turin (IT)

(73) Assignee: ITW Industrial Components S.R.L., Milan (IT)

( * ) Notice: Subject to any disclaimer, the term of this patent is extended or adjusted under 35 U.S.C. 154(b) by 51 days.

(21) Appl. No.: 10/875,951

(22) Filed: Jun. 25, 2004

(65) Prior Publication Data

US 2004/0261225 A1 Dec. 30, 2004

(30) Foreign Application Priority Data

Jun. 26, 2003 (IT) ..... TO2003A0484

(51) Int. Cl.
*E05D 11/08* (2006.01)

(52) U.S. Cl. ..... 16/342; 16/337; 16/54

(58) Field of Classification Search ..... 16/342, 16/337, 273, 51, 50, 54; 220/829, 830; 134/112, 140–143; 4/236, 248; 277/566; 188/290

See application file for complete search history.

(56) References Cited

U.S. PATENT DOCUMENTS 3,317,078 A * 5/1967 Gordon ..... 220/829
3,347,556 A * 10/1967 Fleckenstein et al. ..... 277/566
3,930,594 A * 1/1976 Jungmann ..... 220/830
4,639,147 A * 1/1987 Schwarz ..... 384/125
4,764,035 A * 8/1988 Boyd ..... 384/152
4,832,511 A * 5/1989 Nisley et al. ..... 384/480
5,040,905 A * 8/1991 Boyd ..... 384/130
5,048,715 A * 9/1991 Wolff ..... 220/832
5,419,013 A * 5/1995 Hsiao ..... 16/319
5,636,823 A * 6/1997 Boyd ..... 248/414
5,832,566 A * 11/1998 Quek et al. ..... 16/342
6,052,869 A * 4/2000 Suzuki ..... 16/341
6,178,597 B1 * 1/2001 Suzuki et al. ..... 16/330
6,389,611 B2 * 5/2002 Fujita ..... 4/236
6,393,624 B1 * 5/2002 Iwashita ..... 4/248
6,408,485 B1 * 6/2002 Wu ..... 16/342
6,510,588 B2 * 1/2003 Eromaki ..... 16/308
6,725,503 B1 * 4/2004 Lin ..... 16/76
2001/0010621 A1 8/2001 O'Neal et al.
2002/0121002 A1 * 9/2002 Wu ..... 16/342
2003/0234145 A1 * 12/2003 Iwashita ..... 188/290

FOREIGN PATENT DOCUMENTS

EP 33362 A * 8/1981
EP 409704 A1 * 1/1991

(Continued)

*Primary Examiner*—Chuck Y. Mah

(57) ABSTRACT

A decelerating device includes a bushing and a pin carried coaxially by the bushing. A first end of the pin is housed inside the bushing and a second end of the pin, opposite to the first end, projects axially in cantilever fashion from the bushing. Inside the bushing, between the pin and one internal side wall of the bushing, there are housed, alongside one another, at a pre-set axial distance apart from one another, one or more deformable annular gasket elements. Each deformable annular gasket element has in radial cross section, in undeformed conditions, a peripheral profile defining at least one concavity.

17 Claims, 1 Drawing Sheet

FOREIGN PATENT DOCUMENTS

| | | | | |
|---|---|---|---|---|
| EP | 1 091 068 | | | 4/2001 |
| EP | 1467014 | A1 | * | 10/2004 |
| FR | 2660008 | A1 | * | 9/1991 |
| JP | 62070837 | A | * | 4/1987 |
| JP | 2000342893 | A | * | 12/2000 |

* cited by examiner

DECELERATING DEVICE FOR INSERTION BETWEEN TWO RELATIVELY ROTATING MEMBERS, IN PARTICULAR A DRUM AND AN OSCILLATING DOOR FOR LOADING THE DRUM IN A TOP-LOADED WASHING MACHINE

RELATED APPLICATIONS

The present application is based on, and claims priority from, Italian Application Number TO2003A000484, filed Jun. 26, 2003, the disclosure of which is hereby incorporated by reference herein in its entirety.

The present invention relates to a decelerating device of high efficiency and reliability and low cost and reduced overall dimensions for insertion between two relatively rotating members, in particular a rotating drum and an oscillating door for loading the drum in a top-loaded washing machine.

BACKGROUND OF THE INVENTION

It is known that, in top-loaded washing machines, the drum is provided with two doors equipped with spring-loaded hinges. When the doors, in the closed position, are released, for instance, by actuation of a push-button, springs push the door into the open position, causing the doors to rotate in a radial direction. The opposite movement is performed by exerting manual thrust on the doors so as to bring them back into the closed position, with application of pressure against the action of the springs, which are thus elastically re-loaded.

Since the motion of opening of the doors would prove somewhat too sharp, with consequent danger for the user, it is necessary to provide the doors with decelerating devices in order to dampen the motion of opening.

More in general, in many applications, not only in the field of household appliances but also in the automobile field (for example, the door of the glove-box inside the passenger compartment), it is necessary to dampen the motion of two relatively rotating members.

In general, known decelerating devices comprise a rotor (for instance, a turbine-shaped rotor), which turns immersed in a viscous fluid contained in a casing. The rotor is secured to one of the rotating members, and the casing is secured to the other rotating member. Albeit effective, this type of decelerating device is, however, characterized by large overall dimensions, in particular in the radial direction, and the larger the overall dimensions, the greater the decelerating action required. Consequently, such a device is far from suited to being integrated in a hinge, in particular in a hinge of small dimensions as in the case of the drum of a top-loaded washing machine.

Furthermore, other known types of decelerating device with small radial dimensions simply envisage a rotating pin immersed in the viscous fluid and are consequently not able to generate a high decelerating torque.

SUMMARY OF THE INVENTION

The purpose of the present invention is to overcome the drawbacks described above by providing a decelerating device which is able to develop an adequate resistance which, above all, can be increased during the design stage without modifying the radial dimensions of the device. A further purpose of the invention is to provide a decelerating device which is also of small radial dimensions, presents a simple structure, and is inexpensive to manufacture and reliable in operation.

In particular, according to the invention, the decelerating device includes a bushing and a pin, which is carried in a co-axial position by said bushing, a first end of the pin being housed idle inside said bushing and a second end of the pin, opposite to the first end, projecting axially in cantilever fashion from the bushing. The pin and the bushing are provided with means of constraint to said relatively rotating members, and between the first end of the pin and an internal side wall of the bushing there is housed at least one deformable annular gasket element, on which said pin rotates idle in a frictioned way with respect to said bushing.

Preferably, but without this implying any limitation, the device comprises at least two of said deformable annular gasket elements housed alongside one another at a pre-set axial distance apart from one another.

In addition, each of said deformable annular gasket elements has in radial cross section, in undeformed conditions, a peripheral profile defining at least one annular concavity having an axis of symmetry substantially coinciding with that of the annular element itself.

In this way, it is surprisingly possible to obtain an effective and reliable deceleration of the relative rotation of the two members, which is usually achieved, in use, under the action of a spring, with reduced axial encumbrance. In addition, it is possible to increase the action of deceleration simply by adding in series further deformable gasket elements inserted between the pin and the bushing, this enabling adjustment as desired, in the design stage, of the force of deceleration, without increasing the radial dimensions of the device. It is evident, in fact, that it will be at the most the axial dimensions of the device that increase as the number of deformable gasket elements increases. Finally, it is evident that the cost of such a decelerating device will be very low, and the device will be very simple to manufacture, the major cost, according to the non-limiting example of embodiment illustrated hereinafter, being represented by the special gasket elements (QUAD-RINGS™ produced by the firm Busak & Shamban) selected for use of the invention.

BRIEF DESCRIPTION OF THE DRAWINGS

Further characteristics and advantages of the present invention will emerge clearly from the ensuing description of a non-limiting example of embodiment with reference to the figures of the annexed table of drawings, in which.

DETAILED DESCRIPTION OF THE INVENTION

Figure 1:
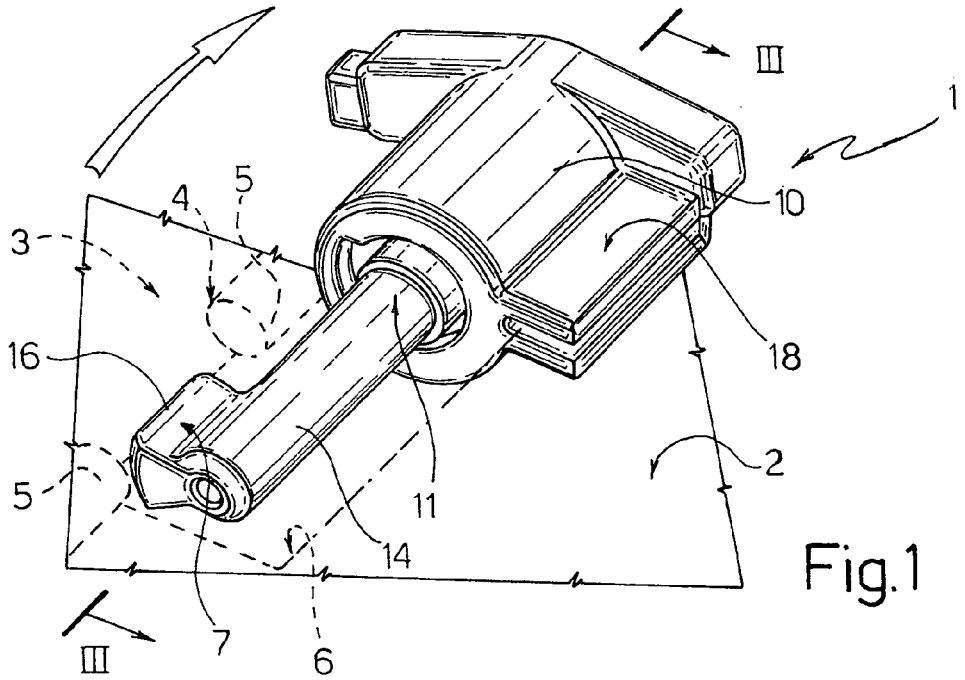
FIG. 1 is a three-quarters front perspective view of a decelerating device built according to the invention, which is schematically illustrated in a partially exploded view of a position of assembly.
Figure 2:
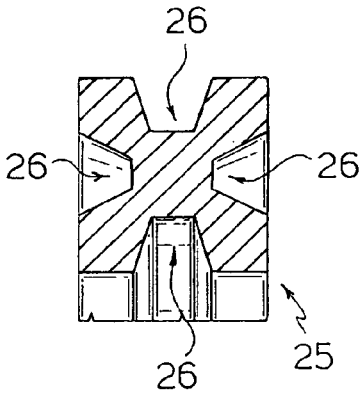
FIG. 2 illustrates a radial cross-sectional view of an internal component of the device of FIG. 1 taken along an axis designated as A in FIG. 1.
Figure 3:
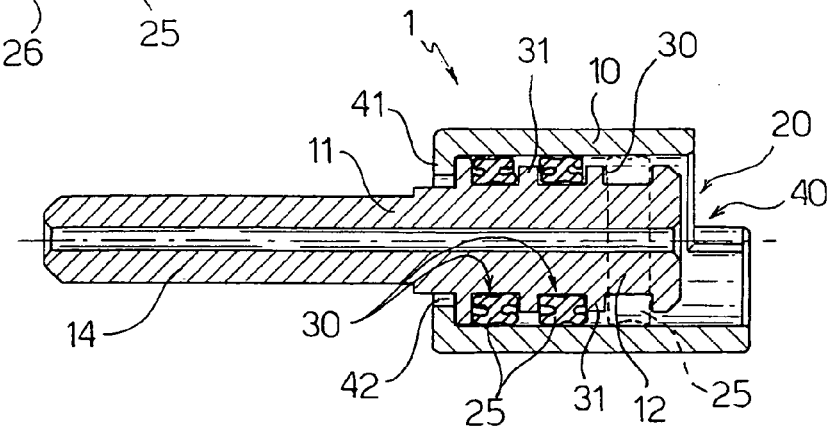
FIG. 3 illustrates the device of FIG. 1 in longitudinal cross section according to a plane of trace III-III.

With reference to FIGS. 1 to 3, designated as a whole by 1 is a decelerating device, which can be inserted in a known way between two relatively rotating members 2 and 3, indicated only schematically by a dashed line with arrowhead, for reasons of simplicity, in FIG. 1. The elements 1, 2 and 3 are illustrated in a partially exploded view of a position of assembly, slightly set apart from one another, in order to facilitate understanding thereof.

In the non-limiting example illustrated, the two members 2 and 3 are constituted, respectively, by a rotating drum 2 for loading of a top-loaded washing machine (known and not illustrated for reasons of simplicity) and by an oscillating door 3 of the aforesaid drum 2. In general, the drum 2 is provided with a pair of doors 3, which open radially, said opening being according to the direction indicated by the arrow in FIG. 1. For reasons of simplicity, only one of said doors 3 is illustrated in FIG. 1. Each of the doors 3 is articulated to the drum 2 by means of a known hinge 4 (of which only some eyelet elements 5 are illustrated).

Each door 3 is moreover loaded by a spring (known and not illustrated), for example mounted in a position corresponding to the axis of rotation of the hinge 4, which determines, in use, opening rotation of the door 3 in the direction indicated by the arrow (see FIG. 1), as soon as a purposely provided mechanism (known and not illustrated) for arresting the door 3 is released.

The decelerating device 1 is mounted, according to the invention, so that it is axially inserted between respective longitudinal edges 6 and 7 of the members 2 and 3 alongside and parallel to the axis of rotation of the hinge 4, which connects the members 2 and 3 together.

With reference to what is illustrated in FIGS. 1 to 3, the device 1 comprises a bushing 10 and a pin 11, which is carried in a co-axial position by the bushing 10. A first cylindrical end 12 of the pin 11 is housed idle inside the bushing 10, which is also of a substantially cylindrical shape, whilst a second end 14 of the pin 11, opposite to the end 12, projects axially in cantilever fashion from the bushing 10, from only one end thereof.

The pin 11 and the bushing 12 are provided with respective means of constraint to the members 2 and 3. In particular, the pin 11 is provided with means of constraint to the edge 7 of the door 3, said means of constraint being constituted by a substantially wedge-shaped tab 16, which extends radially in cantilever fashion from a terminal portion of the end 14 of the pin 11. Instead, the bushing 10 is provided with means of constraint to the edge 6 of the drum 2, said means of constraint being constituted by a fork 18, which extends radially in cantilever fashion from the bushing 10 on the opposite side of the tab 16 of the pin 11.

The tab 16 is shaped so as to fit, in use, on top of the edge 7 so as to be drawn by the latter in rotation in the direction indicated by the arrow upon opening of the door 3, consequently causing the pin 11 to rotate with respect to the bushing 10, which, instead, remains fixed to the drum 2, the said bushing 10 remaining fixedly constrained to the edge 6 by means of the fork 18. Preferably, the bushing 10 is provided, on the side opposite to the projecting end 14 of the pin 11, with a recess 20 (FIG. 3), in order to reduce its radial dimensions over at least one pre-set arc of angle of development of the bushing 10 itself so as to facilitate its installation of the device 1 between the relatively rotating members 2 and 3.

According to the invention, inside the bushing 10, between a cylindrical external side wall of the end 12 of the pin 11 and a cylindrical internal side wall of the bushing 10, there is housed at least one deformable annular gasket element 25, on which the pin 11 rotates idle in a frictioned way. Preferably, according to what is illustrated, without this implying any limitation, the device 1 includes a pair of said elements 25, mounted alongside one another, at a pre-set axial distance apart from one another, on which said pin 11 rotates idle in a frictioned and balanced way with respect to the bushing 10.

According to one aspect of the invention, said deformable annular gasket elements 25 are housed radially forced between said bushing 10 and the end 12 of the pin 11. In addition, in combination, each of said deformable annular gasket elements 25 has, in radial section, in undeformed conditions (see FIG. 2), a peripheral profile defining at least one annular concavity 26 having an axis of symmetry substantially coinciding with said annular element 25 itself.

One of the selected deformable annular gasket elements 25 used in the device according to the invention is illustrated in radial cross section, at an enlarged scale, in FIG. 2. It presents, in radial cross section, in undeformed conditions, a substantially X-shaped peripheral profile, hence having four annular concavities 26 arranged substantially at 90° with respect to one another.

The deformable annular gasket elements 25 selected to be used in the invention are preferably of a commercially available type, marketed under the name "QUAD-RING" (registered trademark) and are produced by the firm Busak & Shamban for a use completely different from that of friction elements, in particular for exclusive use as hydraulic-seal elements in particular situations, in which they are designed to be subject to relative sliding, in addition to relative rotations.

Instead, surprisingly, when they are used as friction elements in the decelerating device according to the invention, the said deformable annular gasket elements 25 have made it possible to develop an effective and progressive action of deceleration, which is maintained constant over time. This is probably thanks to the presence of the concavities 26, which, in the case of forced-fit assembly according to the present invention, enables the rubber (or other elastomeric material with which the elements 25 are made) to "reflow", adapting to the stresses connected to the particular use required in a way that would not be obtainable by a normal toroidal gasket of the O-ring type.

It is clear that, according to a variant illustrated with a dashed line in FIG. 3, the device 1 may also comprise more than two deformable annular gasket elements 25, for example three or more, arranged in axial sequence fitted on the end 12 of the pin 11 housed within the bushing 10.

Preferably, the elements 25 are mounted within purposely provided axial-containment annular seats 30 obtained by means of annular projections 31 made so that they project from the external lateral surface of the end 12 but having an external diameter smaller than the internal diameter of the bushing 10.

The pin 11 is, for instance, housed in the bushing 10 via snap-action, by means of its axial insertion on the side of an open end 40 of the bushing 10, said open end 40 being provided with the recess 20, until the pin comes to bear upon an axial contrast element 41 defined by a bottom wall of the bushing 10, which is provided with a through hole 42, through which the end 14 of the pin 11 projects in cantilever fashion.

The invention claimed is:

1. A decelerating device for damping relative rotation between first and second relatively rotating members, said device comprising a bushing engageable with the first member and having first and second opposite ends; and a pin engageable with the second member and rotatably supported by said bushing, said pin having first and second opposite end portions, the first end portion being housed inside and coaxially and rotatably supported by said bushing, the second end portion projecting axially in cantilever fashion from the second end of the bushing; and at least one deformable annular element for frictionally dampening relative rotation between said pin and said bushing, said annular element being pressed between the first end portion of said pin and an internal wall of the bushing;

wherein said annular element includes an inner circumferential annular face in contact with the first end portion;

an outer circumferential annular face in contact with the internal wall of the bushing;

opposite end faces connected by said inner and outer circumferential annular faces; and an annular recess in each of said inner face, outer face and end faces;

said annular recesses dividing a cross section of said annular element into a central portion and four radial projections, wherein, when said deformable annular element is in a undeformed state, a width of each of said projections gradually increases radially outwardly from a connection of said projection with said central portion;

wherein a space between the internal wall of said bushing and said second end portion of said pin is free of liquid lubricants; and wherein said deformable annular element is housed and radially compressed between said internal side wall of the bushing and the first end portion of said pin, without being axially compressed.

2. The decelerating device according to claim 1, comprising at least two of said deformable annular elements mounted alongside one another at a predetermined axial distance apart from one another.

3. The decelerating device according to claim 1, wherein, when said deformable annular element is in the undeformed state, each said annular recess has an axis of symmetry substantially coinciding with that of said annular element.

4. The decelerating device according to claim 1, wherein said annular recesses are positioned on a periphery of said cross section to be angularly spaced 90° from each other.

5. The decelerating device according to claim 1, wherein said pin includes a substantially wedge-shaped tab engageable with the second member, said tab extending radially in cantilever fashion from a terminal end of said second end portion of the pin; and said bushing includes a fork engageable with the first member, said fork extending radially in cantilever fashion from the first end of said bushing.

6. The decelerating device according to claim 5, wherein said tab and said fork extend in opposite radial directions.

7. An assembly, comprising the decelerating device according to claim 1 and the first and second members rotatably connected by a hinge, wherein said first member is an oscillating door of a drum of a top-loaded washing machine, and said second member is said drum;

said decelerating device being axially inserted between respective longitudinal edges of said first and second members alongside and parallel to said hinge.

8. The decelerating device according to claim 1, wherein said pin includes a substantially wedge-shaped tab engageable with the second member, said tab extending radially in cantilever fashion from a terminal end of said second end portion of the pin.

9. The decelerating device according to claim 1, wherein said bushing includes a fork engageable with the first member, said fork extending radially in cantilever fashion from the first end of said bushing.

10. The decelerating device according to claim 1, wherein said second end portion of said pin is axially supported within said bushing solely by said at least one annular element.

11. The decelerating device according to claim 1, wherein each said recess includes two side walls extending towards said central portion and being slanted at an acute angle relative to each other.

12. The decelerating device according to claim 11, wherein each said recess further includes a flat bottom wall connecting said two side walls.

13. The decelerating device according to claim 12, wherein the end faces of said annular element are generally planar except for the respective recesses in said end faces.

14. The decelerating device according to claim 13, wherein said cross section has a shape of a rectangle with four straight lines which are interrupted by the respective recesses at middles thereof.

15. A decelerating device for damping relative rotation between first and second relatively rotating members, said device comprising:

a bushing engageable with the first member and having first and second opposite ends; and a pin engageable with the second member and rotatably supported by said bushing, said pin having first and second opposite end portions, the first end portion being housed inside and coaxially and rotatably supported by said bushing, the second end portion projecting axially in cantilever fashion from the second end of the bushing; and at least one deformable annular element for frictionally dampening relative rotation between said pin and said bushing, said annular element being pressed between the first end portion of said pin and an internal wall of the bushing;

wherein said annular element includes an inner circumferential annular face in contact with the first end portion;

an outer circumferential annular face in contact with the internal wall of the bushing;

opposite end faces connected by said inner and outer circumferential annular faces; and an annular recess in each of said inner face, outer face and end faces;

said annular recesses dividing a cross section of said annular element into a central portion and four radial projections, wherein, when said deformable annular element is in a undeformed state, a width of each of said projections gradually increases radially outwardly from a connection of said projection with said central portion; and wherein said bushing includes, at the first end thereof, a recess that reduces a radial dimension of said bushing on at least one predetermined arc so as to facilitate installation of said bushing between the first and second members.

16. A decelerating device for damping relative rotation between first and second relatively rotating members, said device comprising a bushing engageable with the first member and having first and second opposite ends;

a pin engageable with the second member and rotatably supported by said bushing, said pin having first and second opposite end portions, the first end portion being housed inside and coaxially and rotatably supported by said bushing, the second end portion projecting axially in cantilever fashion from the second end of the bushing;

at least one deformable annular element for frictionally dampening relative rotation between said pin and said bushing, said annular element being pressed between the first end portion of said pin and an internal wall of the bushing; and at least one of (i) a substantially wedge-shaped tab extending radially in cantilever fashion from a terminal end of said second end portion of the pin, said tab being engageable with the second member, (ii) a fork extending radially in cantilever fashion from the first end of said bushing, said fork being engageable with the first member, and (iii) a recess at the first end of said bushing, wherein said recess reduces a radial dimension of said bushing on at least one predetermined arc so as to facilitate installation of said bushing between the first and second members.

17. An assembly, comprising the decelerating device according to claim 16 and the first and second members rotatably connected by a hinge, wherein said first member is an oscillating door of a drum of a top-loaded washing machine, and said second member is said drum;

said decelerating device being axially inserted between respective longitudinal edges of said first and second members alongside and parallel to said hinge.

* * * * *